US011193331B2

(12) United States Patent
Peters et al.

(10) Patent No.: US 11,193,331 B2
(45) Date of Patent: Dec. 7, 2021

(54) SELF INITIATING BEND MOTOR FOR COIL TUBING DRILLING

(71) Applicants: Volker Peters, Wienhausen (DE); Andreas Peter, Celle Niedersachsen (DE)

(72) Inventors: Volker Peters, Wienhausen (DE); Andreas Peter, Celle Niedersachsen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 48 days.

(21) Appl. No.: 16/439,389

(22) Filed: Jun. 12, 2019

(65) Prior Publication Data

US 2020/0392792 A1 Dec. 17, 2020

(51) Int. Cl.
*E21B 7/06* (2006.01)
*E21B 47/024* (2006.01)
(Continued)

(52) U.S. Cl.
CPC ..... *E21B 7/067* (2013.01); *E21B 7/068* (2013.01); *E21B 47/024* (2013.01); *E21B 4/02* (2013.01); *E21B 17/1078* (2013.01)

(58) Field of Classification Search
CPC ..... E21B 7/067; E21B 7/068; E21B 47/024; E21B 17/1078; E21B 4/02
See application file for complete search history.

(56) References Cited

U.S. PATENT DOCUMENTS 3,011,568 A 12/1961 Grimm
3,380,543 A 4/1968 Vincent
(Continued)

FOREIGN PATENT DOCUMENTS

AU 2005200137 A1 2/2005
CN 104114805 A 10/2014
(Continued)

OTHER PUBLICATIONS

Schlumberger Oilfield Glossary—https://www.glossary.oilfield.slb.com/en/terms/b/bottomhole_assembly (Year: 2020).*
(Continued)

*Primary Examiner* — David Carroll
(74) *Attorney, Agent, or Firm* — Cantor Colburn LLP

(57) ABSTRACT

A drilling system and method of drilling a wellbore. The drilling system includes a tubing, an orientation device affixed to the tubing, a drilling sub having a housing having a first section and a second section, wherein the first section is coupled to a movable element of the orientation device, a shaft disposed in the housing, the shaft coupled to the drive and to the drill bit, and a pivot member coupled to the first section and second section of the housing. The second section of the housing tilts relative to the first section of the housing about the pivot member when the orientation device is rotationally stationary to allow drilling of a curved section of the wellbore. Rotation of the housing via the orientation device reduces the tilt between the first section and the second section to allow for drilling of a straight section of the wellbore.

22 Claims, 11 Drawing Sheets

(51) Int. Cl.
*E21B 17/10* (2006.01)
*E21B 4/02* (2006.01)

(56) References Cited

U.S. PATENT DOCUMENTS

| | | | | |
|---|---|---|---|---|
| 3,586,116 | A | 6/1971 | Francois et al. | |
| 4,442,908 | A | 4/1984 | Steenbock | |
| 4,522,272 | A | 6/1985 | Beimgraben | |
| 4,655,299 | A | 4/1987 | Schoeffler | |
| 4,811,798 | A | 3/1989 | Falgout, Sr. et al. | |
| 4,884,643 | A | 12/1989 | Wawrzynowski et al. | |
| 4,895,214 | A | 1/1990 | Schoeffler | |
| 5,048,621 | A | 9/1991 | Bailey et al. | |
| 5,117,927 | A | 6/1992 | Askew | |
| 5,154,243 | A | 10/1992 | Dudman | |
| 5,181,576 | A | 1/1993 | Askew et al. | |
| 5,195,754 | A | 3/1993 | Dietle | |
| 5,259,467 | A | 11/1993 | Schoeffler | |
| 5,269,385 | A | 12/1993 | Sihlis | |
| 5,314,032 | A | 5/1994 | Pringle et al. | |
| 5,423,389 | A | 6/1995 | Warren et al. | |
| 5,778,992 | A | 7/1998 | Fuller | |
| 5,899,281 | A | 5/1999 | Gynz-Rekowski | |
| 5,941,323 | A | 8/1999 | Warren | |
| 6,047,784 | A | 4/2000 | Dorel | |
| 6,203,435 | B1 | 3/2001 | Falgout, Sr. | |
| 6,216,802 | B1 | 4/2001 | Sawyer | |
| 6,598,687 | B2 | 7/2003 | Eppink et al. | |
| 6,659,201 | B2 | 12/2003 | Head et al. | |
| 7,204,325 | B2 | 4/2007 | Song et al. | |
| 7,287,604 | B2 | 10/2007 | Aronstam et al. | |
| 7,392,857 | B1 | 7/2008 | Hall et al. | |
| 9,957,755 | B2 | 5/2018 | Schurmann | |
| 2001/0052427 | A1 | 12/2001 | Eppink et al. | |
| 2002/0007969 | A1* | 1/2002 | Head | E21B 7/067 175/61 |
| 2003/0127252 | A1 | 7/2003 | Downton et al. | |
| 2005/0109542 | A1 | 5/2005 | Downton | |
| 2006/0096784 | A1 | 5/2006 | Mohrmann | |
| 2006/0243487 | A1 | 11/2006 | Turner et al. | |
| 2007/0114068 | A1 | 5/2007 | Hall et al. | |
| 2007/0163810 | A1 | 7/2007 | Underwood et al. | |
| 2008/0149394 | A1 | 6/2008 | Downton | |
| 2008/0158006 | A1 | 7/2008 | Pisoni et al. | |
| 2009/0133930 | A1 | 5/2009 | Thorp et al. | |
| 2009/0166089 | A1 | 7/2009 | Millet | |
| 2009/0205867 | A1 | 8/2009 | Reckmann et al. | |
| 2009/0260884 | A1* | 10/2009 | Santelmann | E21B 7/062 175/61 |
| 2009/0266611 | A1 | 10/2009 | Camp | |
| 2011/0308858 | A1 | 12/2011 | Menger et al. | |
| 2012/0018225 | A1 | 1/2012 | Peter et al. | |
| 2013/0043076 | A1 | 2/2013 | Larronde et al. | |
| 2014/0110178 | A1 | 4/2014 | Savage et al. | |
| 2014/0231136 | A1 | 8/2014 | Winslow | |
| 2015/0176344 | A1 | 6/2015 | McLoughlin et al. | |
| 2016/0069139 | A1 | 3/2016 | Sugiura et al. | |
| 2016/0258218 | A1* | 9/2016 | Lange | E21B 17/20 |
| 2016/0281431 | A1 | 9/2016 | Peters et al. | |
| 2017/0067333 | A1 | 3/2017 | Peters | |
| 2017/0074041 | A1 | 3/2017 | Peters | |
| 2017/0074042 | A1* | 3/2017 | Peters | E21B 7/068 |
| 2017/0247947 | A1 | 8/2017 | Savage et al. | |

FOREIGN PATENT DOCUMENTS

| | | | |
|---|---|---|---|
| EP | 0015137 | A1 | 9/1980 |
| GB | 2442303 | A | 4/2008 |
| RU | 2114273 | C1 | 6/1998 |
| RU | 2131508 | C1 | 6/1999 |
| RU | 2179226 | C2 | 2/2002 |
| RU | 2229012 | C2 | 5/2004 |
| RU | 2444604 | C1 | 3/2012 |
| WO | 2013122603 | A1 | 8/2013 |
| WO | 2014120326 | A1 | 8/2014 |
| WO | 2014200416 | A | 12/2014 |
| WO | 2016057445 | A1 | 4/2016 |

OTHER PUBLICATIONS

Schlumberger Oilfield Glossary—https://www.glossary.oilfield.slb.com/en/terms/s/sub (Year: 2020).*

EP Search Report dated Mar. 24, 2020; EP Application No. EP 17853861; 8 pages.

European Search Report dated Nov. 9, 2018; Application No. EP 16769649; 8 pages.

PCT International Search Report and Written Opinion; International Application No. PCT/US2016/023886; International Filing Date: Mar. 24, 2016; dated Jun. 27, 2016; pp. 1-13.

PCT International Search Report and Written Opinion; International Application No. PCT/US2017/052652; International Filing Date: Sep. 21, 2017; dated Jan. 4, 2018; pp. 1-16.

PCT International Search Report and Written Opinion; International Application No. PCT/US2017/052654; International Filing Date: Sep. 21, 2017; dated Jan. 8, 2018; pp. 1-17.

PCT International Search Report and Written Opinion; International Application No. PCT/US2017/052655; International Filing Date: Sep. 21, 2017; dated Dec. 14, 2017; pp. 1-15.

International Search Report; PCT Application No. PCT/US2020/036956; dated Sep. 21, 2020; 4 pages.

Written Opinion; PCT Application No. PCT/US2020/036956; dated Sep. 21, 2020; 8 pages.

* cited by examiner

SELF INITIATING BEND MOTOR FOR COIL TUBING DRILLING

BACKGROUND

In the resource recovery industry, a coiled tubing refers to a long pipe that is extended into a wellbore. Coiled tubing can include drilling system at a bottom end for drilling a wellbore. Coiled tubing drilling systems can use orientation tools and fixed bend motors for directional control. One of the limitations of using coil tubing for drilling is the limited reach capability caused by the combination of an inability to rotate the coil and the demand for high dogleg capabilities.

SUMMARY

Disclosed herein is a method of drilling a wellbore. The method includes disposing a tubing in the wellbore, the tubing including an orientation device coupled to the tubing and a drilling sub connected to the orientation device and rotatable by the orientation device. The drilling sub includes a drive configured to rotate a drill bit at an end of the drilling sub, a housing having a first section and a second section, and a pivot member coupled to the first section and second section of the housing. A tilt is produced between the second section and the first section of the housing about the pivot member by maintaining the orientation device rotationally stationary to allow drilling of a curved section of the wellbore via rotation of the drive. The orientation device is rotated to reduce the tilt between the first section and the second section, thereby allowing drilling of a straighter section of the wellbore.

Also disclosed herein is a drilling system. The drilling system includes a tubing, an orientation device affixed to the tubing, a drilling sub having a housing having a first section and a second section, wherein the first section is coupled to a movable element of the orientation device, a shaft disposed in the housing, the shaft coupled to the drive and to the drill bit, and a pivot member coupled to the first section and second section of the housing, wherein the second section of the housing tilts relative to the first section of the housing about the pivot member when the orientation device is rotationally stationary to allow drilling of a curved section of the wellbore, and wherein rotation of the housing via the orientation device reduces the tilt between the first section and the second section to allow for drilling of a straighter section of the wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
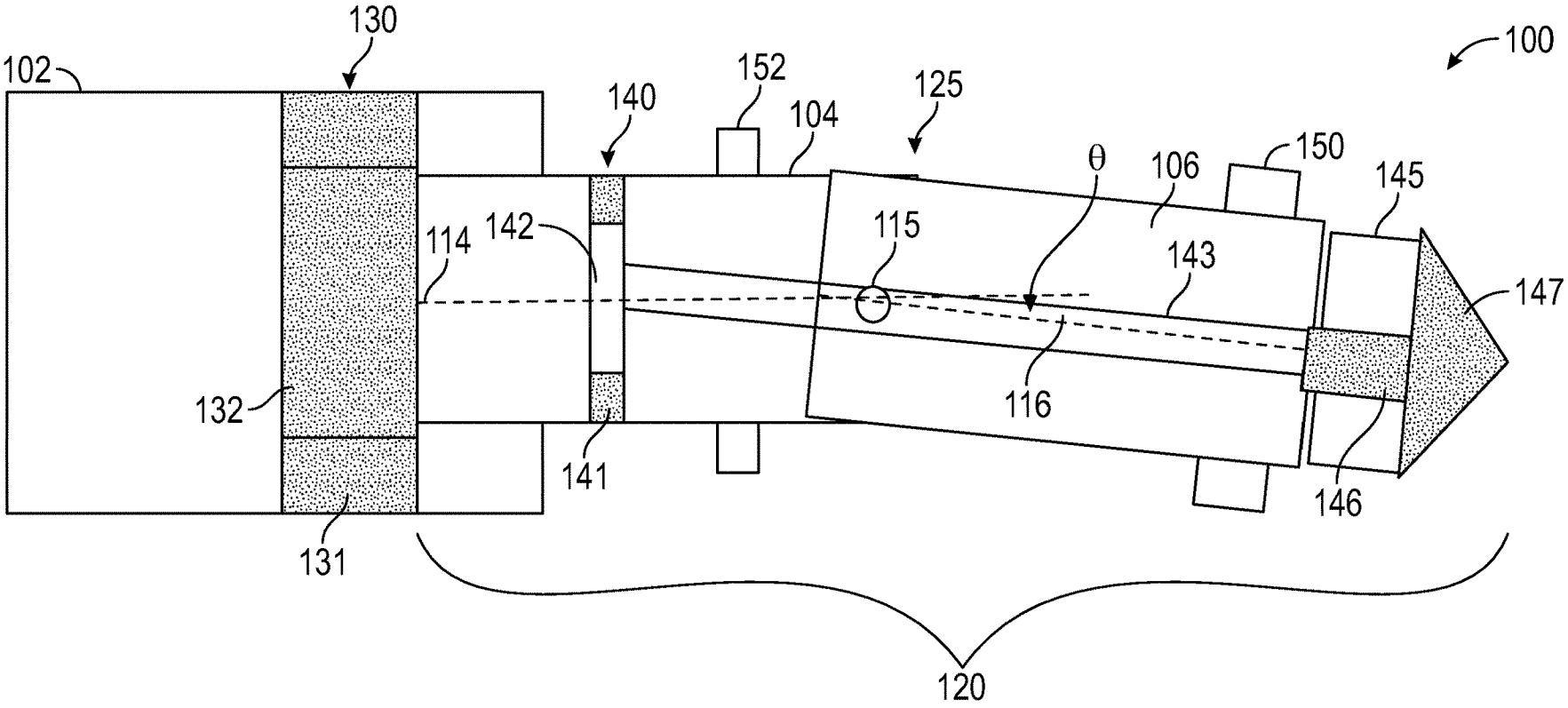
FIG. 1 shows a coiled tubing drilling assembly with a self-initiating bend (SIB) drilling assembly for drilling a wellbore.

FIG. 1 shows a coiled tubing drilling assembly 100 suitable for drilling a wellbore. The coiled tubing drilling assembly 100 includes a coiled tubing 102 with a drilling sub 120 at an end thereof in the form of a self-initiating bend (SIB) assembly. The coiled tubing 102 is extended from a surface location to the downhole location through the wellbore. The drilling sub 120 is capable of drilling both curved and straight sections of the wellbore 101. The drilling sub 120 includes a housing 125 having an upper section or first section 104 and a lower section or second section 106. In various embodiments, the housing 125 is a tubular member and the upper section is an upper tubular member and the lower section is a lower tubular member. The drilling sub 120 further includes a downhole drive such as a mud motor 140 disposed within the housing 125. In various embodiments, the mud motor 140 is disposed within the first section 104 of the housing 125. The mud motor 140 includes a stator 141 and rotor 142. The stator 141 is mechanically coupled to the housing 125 and/or the first section 106 of the housing 125. The rotor 142 rotates with respect to the stator 141 when a drilling fluid or drilling mud is circulated through the mud motor 140. The rotor 142 is coupled to a transmission shaft 143, such as a flexible shaft, that is coupled to another shaft 146 disposed in a bearing assembly 145. The shaft 146 passes through the bearing assembly 145 and is coupled to a drill bit 147. A rotation of the rotor 142 of the mud motor 140 therefore can be used to rotate the drill bit 147 via transmission shaft 143 and shaft 146. Although the downhole drive is shown to be a mud motor 140, any other suitable drive may be utilized to rotate the drill bit 147.

The housing 125 is mechanically coupled to an orientation device 130, or orienter, disposed within the coiled tubing 102. In particular, the first section 104 of the housing 106 is mechanically coupled to the orientation device 130. The orientation device 130 may be electrically controlled. In various embodiments, an electrical signal is provided from a surface location to the orientation device 130 to control the orientation of the orientation device 130. The orientation device 130 includes a stator section 131 that is secured to the coiled tubing 102 and a rotor section 132 that moves or rotates with respect to the stator section 131.

The orientation device 130 can be toggled through various positions. For example, the rotor section 132 can be toggled to face to the left or to the right. Additionally, the rotor section 132 can be made to rotate continuously in either a clockwise or counter-clockwise direction. Rotation of the orientation device 130 rotates the housing 125. The housing 125 is coupled to the drill bit 147 via the bearing assembly 145. The revolution of the housing 125 via the orientation device 130 is transferred to a revolution of the drill bit 147 via the housing 125 and bearing assembly 145. The drill bit 147 can therefore be rotated by rotating either the mud motor 140, the housing 125 or a combination of the mud motor 140 and the housing 125.

The first section 104 of the housing 125 is connected to the second section 106 of the housing 125 via a pivot member 115. In various embodiments, the pivot member 115 passes through a hole in the first section 104 and a hole in the second section 106 in order to form a hinged connection between the first section 104 and second section 106. In FIG. 1, the mud motor 140 is shown with the pivot member 115 between the mud motor 140 and the drill bit 147. However, in other embodiments, the mud motor 140 can be located between the pivot member 115 and the drill bit 147.

In various embodiments, the housing 125 tilts a selected amount within a selected plane defined by the pivot member 115 to tilt the drill bit 147 along the selected plane to allow drilling of curved wellbore sections. In particular, a tilt in the housing 125 means that the first section 104 and the section 106 form a tilt angle θ with respect to each other. The tilt angle θ can be defined as the angle between a longitudinal axis 114 of the first 104 section and a longitudinal axis 116 of the second section 106. When drilling a straight section of the wellbore, the longitudinal axes 114, 116 are aligned or substantially aligned, (i.e., the tilt angle θ is 0° or substantially 0°).

As described later in reference to FIGS. 2-6, a tilt (i.e., a non-zero tilt angle) is initiated between the first section 104 and the second section 106 when the housing 125 is held is stationary or non-rotating or substantially non-rotating. A curved section 106 of the wellbore can then be drilled by rotating the mud motor 140 to rotate the drill bit 147 while maintaining the housing 125 stationary or substantially non-rotating. In order to reduce the tilt angle θ between the first section 104 and second section 106, the housing 125 itself is rotated via rotation of the orientation device 130, i.e., rotation of the rotor section 132 of the orientation device 130. Reducing the tilt angle θ between the first section 104 and the second section 106 thereby allows drilling of a straight (or straighter) section of the wellbore. Thus, the drilling sub 120 drills a curved section of the wellbore when the housing 125 of the drilling sub 120 is held rotationally stationary while the drill bit 147 is rotated by the mud motor 140. Rotating the housing 125 via the orientation device causes the housing 125 to straighten out, thereby allowing drilling of a straight section of the wellbore.

In one embodiment, a stabilizer 150 is provided below the pivot member 115 (i.e., between the pivot member and the drill bit 147). The stabilizer 150 can be used to initiate a non-zero tilt angle θ in the housing 125 as well as to maintain the non-zero tilt angle θ when the housing 125 is not being rotated while a weight on the drill bit 147 is applied during drilling of the curved wellbore section. In another embodiment, a stabilizer 152 can be provided above the pivot member 115 (i.e., with the pivot member between the stabilizer 152 and the drill bit) in addition to or without the stabilizer 150 to initiate the bending moment at the pivot member 115 and to maintain the tilt during drilling of a curved wellbore section. In other embodiments, more than one stabilizer may be provided above and/or below the pivot member 115. Modeling can be performed to determine the location and number of stabilizers for optimum operation.

Figure 2:
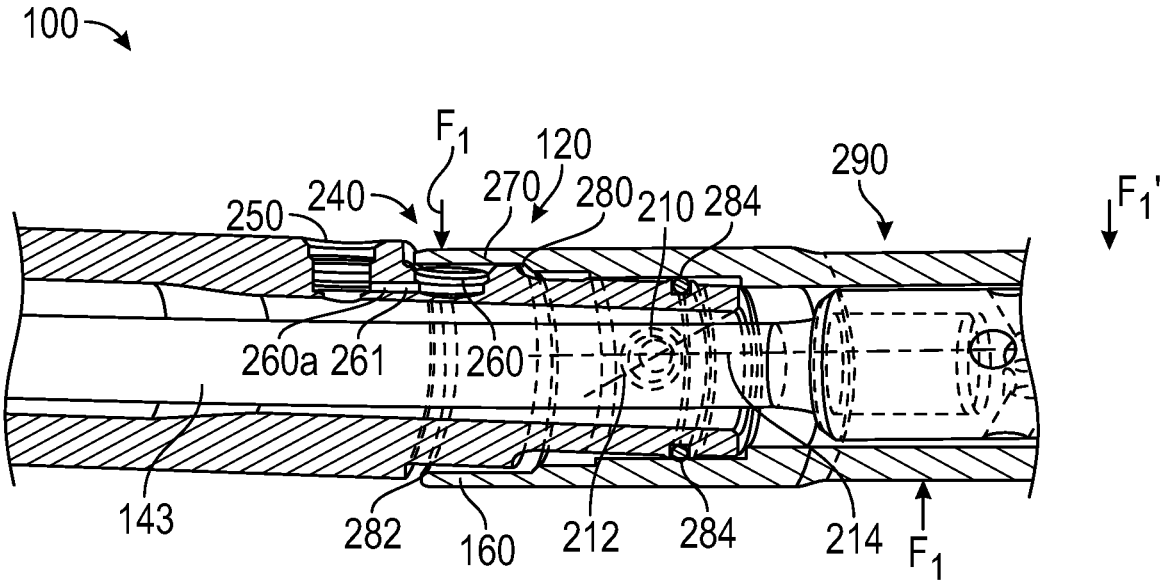
FIG. 2 shows a non-limiting embodiment of a region of the drilling sub of the SIB drilling assembly at which the first section connects to the second section.

FIG. 2 shows a non-limiting embodiment of a region of the drilling sub 120 at which the first section 104 connects to the second section 106. Referring to FIGS. 1 and 2, in one non-limiting embodiment, the region includes a pivot member 115. The pivot member 115 can be a pin having a longitudinal axis 214 perpendicular to the longitudinal axis 116 of the second section 106. Alternatively, the pivot member 115 can be a ball joint. The second section 106 rotates about the pivot member 115 to form a tilt or incline having a selected tilt angle θ. The second section 106 rotates within a plane defined perpendicular to the longitudinal axis 214 of the pivot member 115. The angular range of the tilt angle θ is bound by a straight end stop 282 that defines a straight drilling sub 120 and an inclined end stop 280 that defines a maximum tilt between first section 104 and the second section 106. When the second section 106 straightens with respect to the first section 104, the straight end stop 282 defines the straight position of the drilling sub 120, i.e., where the tilt angle θ is zero. As shown in FIG. 2, a portion of the first section 104 resides within a portion of the second section 106. One or more seals, such as seal 284, is provided between the outer diameter of the portion of the first section 104 lying with the second section 106 and the inner diameter of the second section 106 in order to seal the second section 106 below the seal 284 to prevent an influx of material from the outside environment, such as drilling fluid.

Still referring to FIGS. 1 and 2, a weight can be applied on the bit 147 while the housing 125 is held rotationally stationary in order to initiate a tilt of the second section 106 with respect to the first section 104 about the pivot axis 212 of the pivot member 115. The stabilizer 150 below the pivot member 115 initiates a bending moment at the pivot member 115 and also maintains the tilt while the housing 125 is held rotationally stationary as a weight is applied on the drill bit 147. Similarly, stabilizer 152, in addition to or without the stabilizer 150, also initiates the bending moment and maintains the tilt during drilling of a curved wellbore section as weight is applied to the drill bit 147. In one non-limiting embodiment, a dampening device or dampener 240 may be provided to control the rate at which a tilt occurs in the housing 125 when the housing 125 is rotationally stationary and to aid in the straightening of the housing 125 when the housing 125 is rotated. In one non-limiting embodiment, the dampener 240 may include a piston 260 and a compensator 250 in fluid communication with the piston 260 via a conduit or path 260*a*. Applying a force F1 on a housing section 270 will cause the housing 125 and thus the second section 106 to tilt about the pivot axis 212. Applying a force F1' opposite to the direction of force F1 on the housing section 270 causes the housing section 270 and thus the drilling sub 120 to straighten. The dampener 240 may also be used to stabilize the straightened position of the housing 125 during rotation of the drilling sub 120 via the orientation device 130. The operation of the dampening device 240 is described in more detail in reference to FIGS. 6A and 6B. Any other suitable device, however, may be utilized to reduce or control the rate of the tilt in the drilling sub 120 about the pivot member 115.

Figure 3:
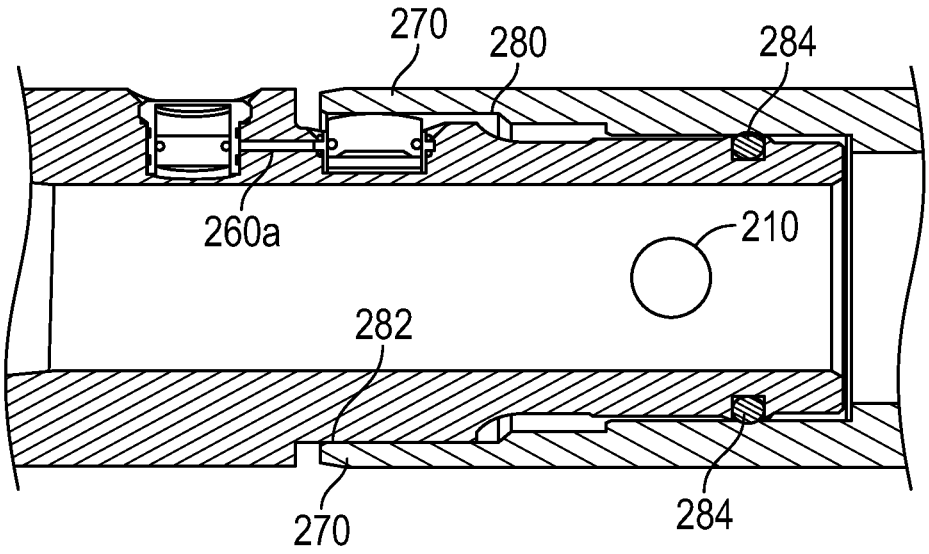
FIG. 3 shows the drilling sub wherein the first section and the second section are aligned in the straight position.

Referring now to FIGS. 1-3, when the orientation device 130 is rotationally stationary and a weight is applied on the drill bit 147, an angle will be initiated between the first section 104 and the second section 106 at the pivot member 115 about the pivot axis 212. The downhole mud motor 140 can then rotate to cause the drill bit 147 to drill a curved section of the wellbore. As the drilling continues, the continuous weight applied on the drill bit 147 increases the tilt angle θ until the tilt angle θ reaches a maximum value defined by the inclined end stop 280. Thus, in one aspect, a curved section may be drilled at a tilt angle defined by the inclined end stop 280. If the dampening device 240 is included in the drilling assembly 100 as shown in FIG. 2, tilting the housing 125 about the pivot member 115 will cause the housing section 270 to apply a force F1 on the piston 260, causing a fluid 261, such as oil, to transfer from the piston 260 to the compensator 250 via a conduit or path 260*a*. The flow of the fluid 261 from the piston 260 to the compensator 250 may be restricted to control the rate of increase of the tilt and to avoid a sudden tilting of the lower section 290, as described in more detail in reference to FIGS. 6A and 6B.

In the particular illustrations of FIGS. 1 and 2, the drill bit 147 will drill a curved section. To drill a straight section after drilling the curved section, the drilling sub 120 may be rotated 180 degrees to remove the tilt and then later rotated via the orientation device 130 to drill the straight section. However, when the drilling sub 120 is rotated, based on the positions of the stabilizers 150 and/or 152 and the well path, bending forces in the wellbore act on the housing 125 and exert forces in opposite direction to the direction of force F1, thereby straightening the housing 125 and thus the drilling sub 120, which allows the fluid 161 to flow from the compensator 250 to the piston 260 causing the piston 260 to move outwards. Such fluid flow may not be restricted, which allows the housing 125 and thus the lower section 106 to straighten rapidly (without substantial delay). The outward movement of the piston 260 may be supported by either a spring positioned in force communication with the piston 260 or the compensator 250. The straight end stop 282 restricts the movement of the housing section 270, causing the second section 106 to remain straight as long as the drilling sub 120 or housing 125 is being rotated. Thus, the embodiment of the drilling sub 120 shown in FIGS. 1 and 2 provides a self-initiating tilt when the drilling sub 120 is stationary (not rotated) or substantially stationary and straightens itself when the drilling sub 120 is rotated. FIG. 3 shows the drilling sub 120 wherein the first section 104 and the second section 106 are aligned in the straight position, wherein the housing section 270 rests against the straight end stop 282.

Figure 4:
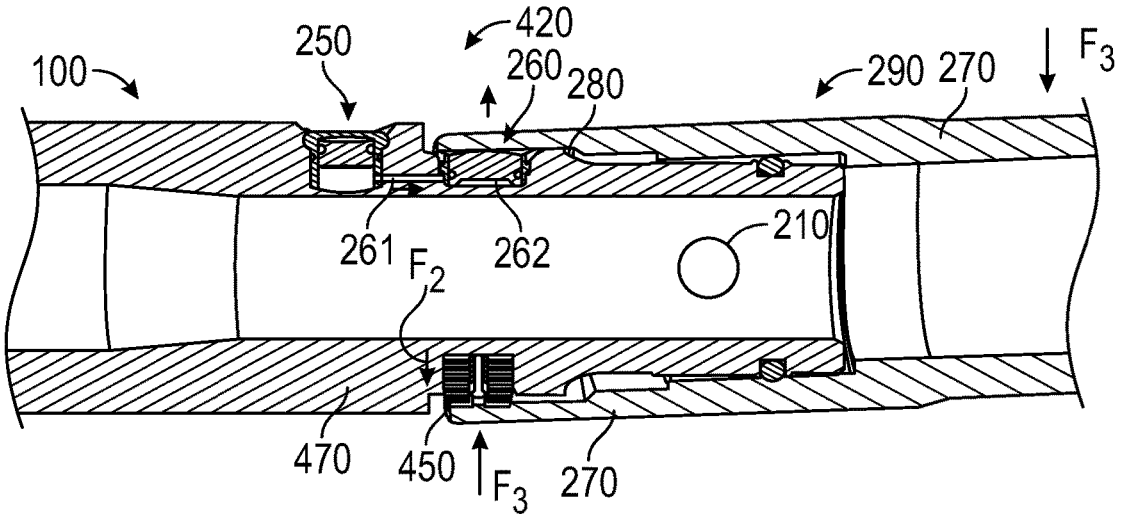
FIG. 4 shows another non-limiting embodiment of a deflection device that includes a force application device for initiating a tilt to the second section.

FIG. 4 shows another non-limiting embodiment of a deflection device 420 that includes a force application device, such as a spring 450 that continually exerts a radially outward force F2 on the housing section 270 of the second section 106 to provide or initiate a tilt to the lower or second section 106. In one embodiment, the spring 450 may be placed between the inside of the housing section 270 and a housing section 470 outside the transmission shaft 143. In this embodiment, the spring 450 causes the housing section 270 to move radially outward about the pivot 210 up to the maximum bend defined by the inclined end stop 280. When the drilling sub 120 is rotationally stationary or substantially rotationally stationary, a weight on the drill bit 147 is applied and the drill bit 147 is rotated by the downhole mud motor 140, the drill bit 147 will initiate the drilling of a curved section. As drilling continues, the tilt increases to its maximum level defined by the inclined end stop 280. To drill a straight section, the drilling assembly 100 is rotated via the orientation device 130, which causes the wellbore to apply force F3 on the housing 270, compressing the spring 450 to straighten the drilling assembly 100. When the spring 450 is compressed by application of force F3, the housing section 270 relieves pressure on the piston 260, which allows the fluid 261 from the compensator 250 to flow back to piston 260 without substantial delay, as described in more detail in reference to FIGS. 6A and 6B.

Figure 5:
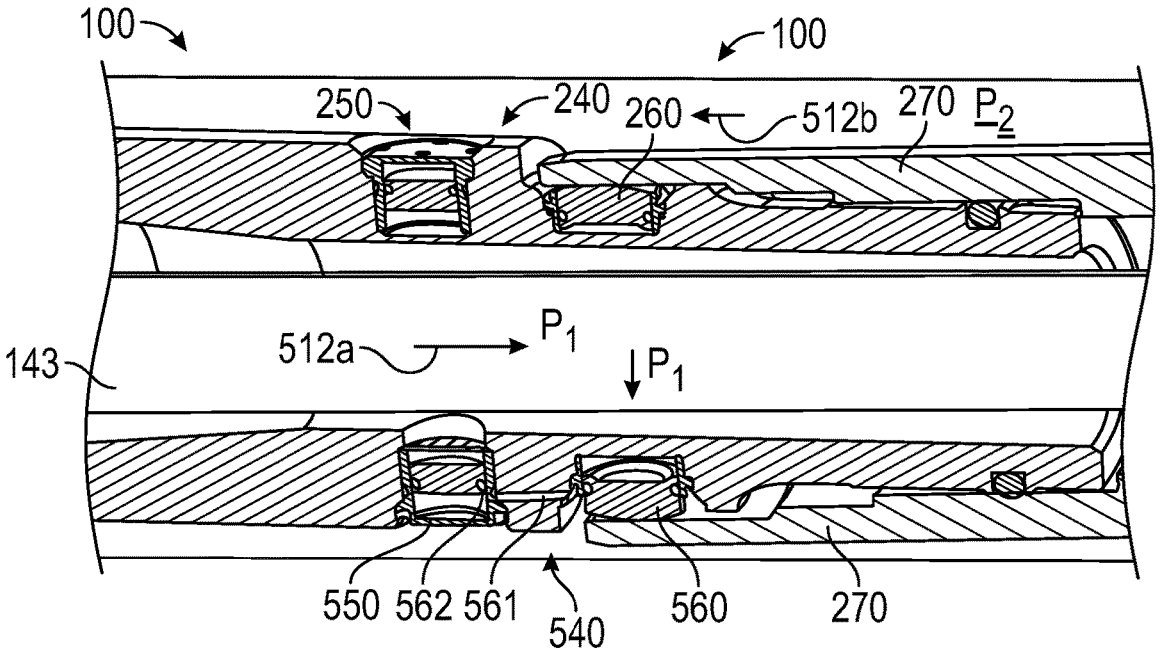
FIG. 5 shows a non-limiting embodiment of a hydraulic force application device to initiate a selected tilt in the drilling sub.

FIG. 5 shows a non-limiting embodiment of a hydraulic force application device 540 to initiate a selected tilt in the drilling sub 120. In one non-limiting embodiment, the force application device 540 includes a piston 560 and a compensation device or compensator 550. The drilling sub 120 also may include a dampening device or dampener, such as dampener 240 shown in FIG. 2. The dampening device 240 can include a piston 260 and a compensator 250 shown and described in reference to FIG. 2. The force application device 540 may be placed 180 degrees opposite from dampening device 240. The piston 560 and compensator 550 are in hydraulic communication with each other. During drilling, a fluid 512*a*, such as drilling mud, flows under pressure through the drilling sub 120 and returns to the surface via an annulus between the drilling sub 120 and the wellbore as shown by fluid 512*b*. The pressure P1 of the fluid 512*a* in the drilling sub 120 is greater (typically 20-50 bars) than the pressure P2 of the fluid 512*b* in the annulus. When fluid 512*a* flows through the drilling sub 120, pressure P1 acts on the compensator 550 and correspondingly on the piston 560 while pressure P2 acts on compensator 250 and correspondingly on piston 260. Pressure P1 being greater than pressure P2 creates a differential pressure (P1−P2) across the piston 560, which pressure differential is sufficient to cause the piston 560 to move radially outward, which pushes the housing section 270 in a direction that initiates a tilt. A restrictor 562 may be provided in the compensator 550 to reduce or control the rate of the tilt as described in more detail in reference to FIGS. 6A and 6B. Thus, when the orientation device 130 is rotationally stationary or substantially rotationally stationary, the piston 560 slowly bleeds the hydraulic fluid 561 through the restrictor 562 until the maximum tilt angle is achieved. The restrictor 562 may be selected to create a high flow resistance to prevent rapid piston movement which may be present during tool face fluctuations of the drilling sub to stabilize the tilt. The differential pressure piston force is always present during circulation of the mud and the restrictor 562 limits the rate of the tilt. When the drilling sub 120 is rotated (via rotation of the orientation device 130), bending moments on the housing section 270 force the piston 560 to retract, which straightens the drilling sub 120 and then maintains the drilling sub 120 straight as long as the drilling sub 120 is rotated. The dampening rate of the dampening device 240 may be set to a higher value than the rate of the force application device 540 in order to stabilize the straightened position during rotation of the drilling sub 120.

Figure 6A:
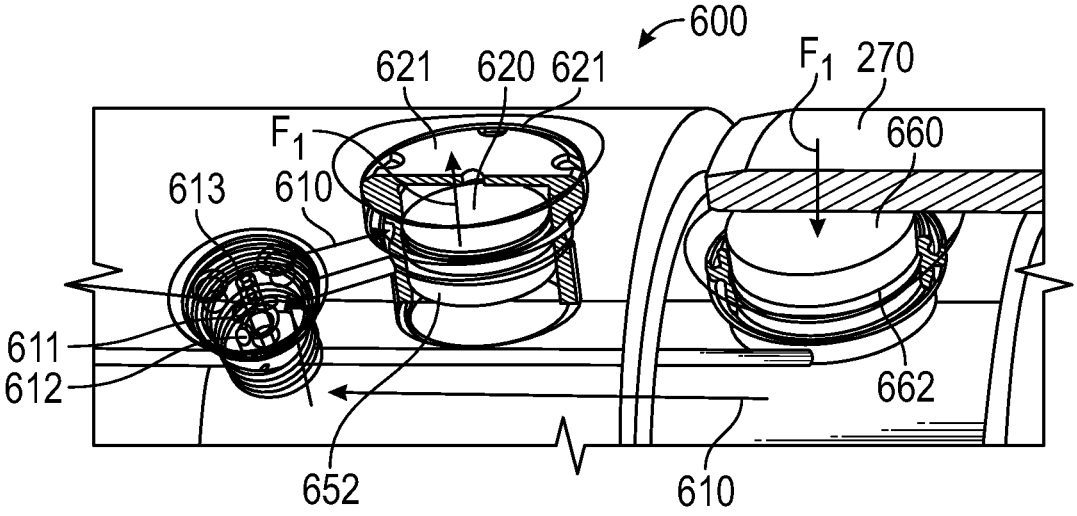
FIGS. 6A and 6B show details of the dampening device.
Figure 6B:
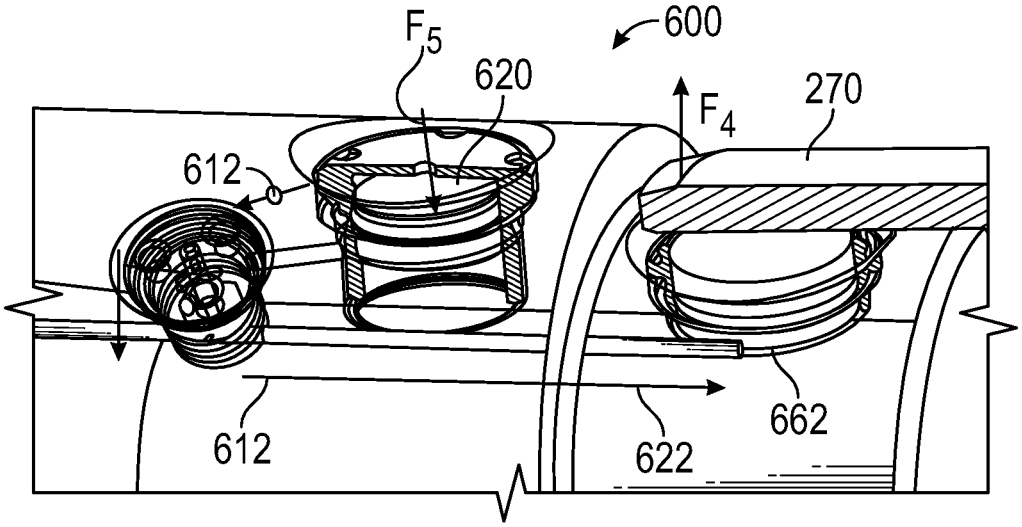

FIGS. 6A and 6B show certain details of the dampening device 600, which is the same as the dampening device 240 in FIGS. 2, 4 and 5. Referring to FIG. 2 and FIGS. 6A and 6B, when the housing 270 applies force F1 on the piston 660, it moves a hydraulic fluid (such as oil) from a chamber 662 associated with the piston 660 to a chamber 652 associated with a compensator 620, as shown by arrow 610. A restrictor 611 restricts the flow of the fluid from the chamber 662 to chamber 652, which increases the pressure between the piston 660 and the restrictor 611, thereby restricting or controlling the rate of the tilt. As the hydraulic fluid flow continues through the restrictor 611, the tilt continues to increase until reaching the maximum level defined by the end inclination stop 280 shown and described in reference to FIG. 2. Thus, the restrictor 611 defines the rate of increase of the tilt. Referring to FIG. 6B, when force F1 is released from the housing 270, as shown by arrow F4, force F5 on compensator 620 moves the fluid from chamber 652 back to the chamber 662 of piston 660 via a check valve 612, bypassing the restrictor 611, which enables the housing 270 to move to its straight position without substantial delay. A pressure relief valve 613 may be provided as a safety feature to avoid excessive pressure beyond the design specification of hydraulic elements.

Figure 7:
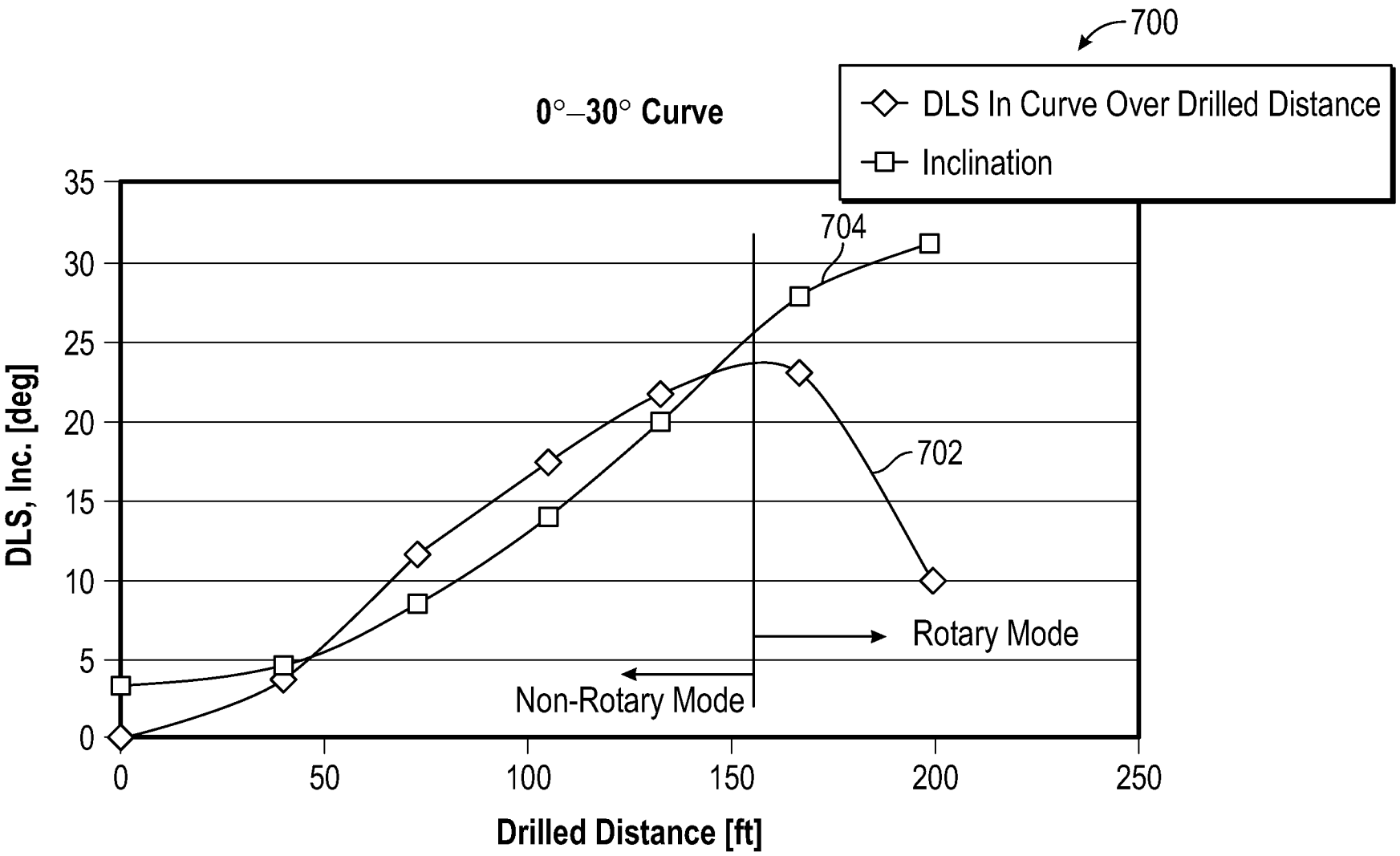
FIG. 7 shows a graph illustrating a behavior of the self-initiating bend (SIB) assembly in various drilling modes.

FIG. 7 shows a graph 700 illustrating a behavior of the self-initiating bend (SIB) assembly in various drilling modes. The graph 700 shows an angular deviation in degrees along the y-axis and a drilled distance in feet along the x-axis. Curves for a dog leg severity (DLS) 702 and an inclination 704 of the wellbore are shown. The wellbore is drilled with the SIB assembly in a non-rotating mode over an interval from 0 feet to about 150 feet. The non-rotating mode includes drilling with the drilling sub with a tilt. At 150 feet, the wellbore is drilled with the SIB assembly in a rotating mode, thus straightening the drilling sub.

During the non-rotating mode, as the drilling progresses, the dog leg severity of the wellbore increases from about 4 degrees to about 23 degrees at 150 feet. During the rotating mode, the drilling straightens out, thereby reducing the dog leg severity after about 150 feet. The inclination 704 of the wellbore increases during the non-rotating mode from about 0 degrees to about 25 degrees. As the drill string straightens during the rotating mode, the inclination slows its increase.

The use of the SIB assembly allows for the coiled tubing drill assembly to achieve a high dogleg angle while reducing friction when drilling in the straight sections. Use of an assembly featuring a bend housing that is straight for the straight section and bend for the curved section reduces the sliding friction of the coil tubing in the wellbore and reduces wellbore tortuosity.

FIGS. 8-12 illustrate the self-stabilizing effect of a slow string or orienter rotation of a self-initiating bend (SIB) assembly. For these figures (based on FIG. 7), an ROP of 300 feet per hour is used with an orienter having an RPM of 1 revolution per 3 minutes.

At these rotation rates, the tool face points in opposite directions after every 90 seconds or 7.5 ft. By continuously changing the toolface in the tangent section at these rates, the orientation device does not allow enough time for the drill bit to create a curvature or tortuosity of the wellbore. Based on the graph of FIG. 7, the dog leg severity after 7.5 feet is approximately 10% of the maximum dog leg severity. Hence, at a very rough and conservative assessment, the tortuosity of the wellbore can be kept as small as 10% of the tortuosity made with a conventional fixed bend motor.

Figure 8:
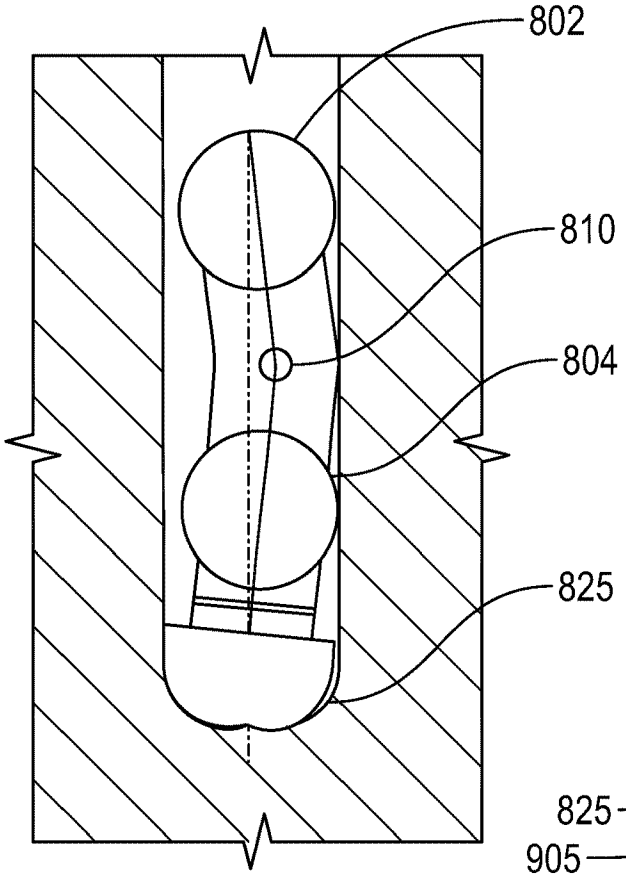

FIG. 8 shows the SIB assembly with a significant tilt (high title angle) and disposed in a straight wellbore. The SIB assembly incudes a stabilizer 802, stabilizer 824, pivot member 810 and drill bit 825. The SIB assembly is being slowly rotated from the orientation device and with the bit being additionally by the mud motor.

Figure 10:
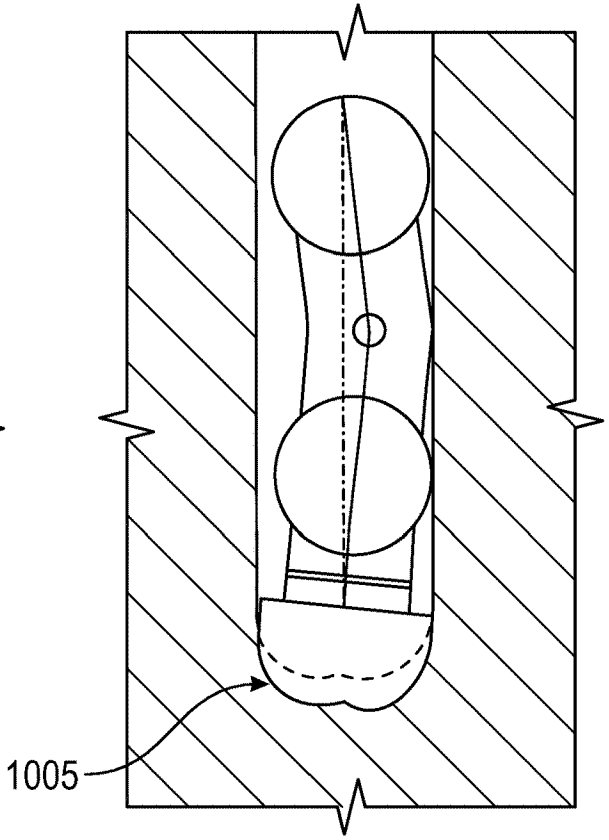
FIGS. 8-12 illustrate the self-stabilizing effect of a slow string or orientation device rotation of a self-initiating bend (SIB) assembly.
Figure 9:
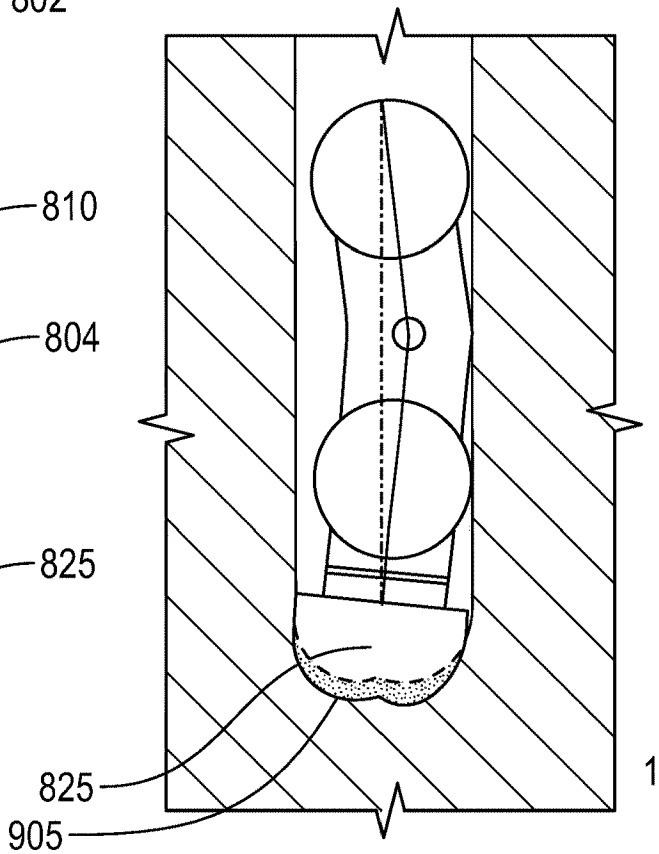

FIGS. 9 and 10 show the drilling process performed with the SIB assembly maintaining the high tilt angle of FIG. 8. FIG. 9 shows the drill bit 825 momentarily cutting away rock cutting 905. As shown in FIG. 10, since the drill bit 825 cuts the rock in the momentary direction at a rate quicker than the orientation device can move the drill bit from this momentary direction, the wellbore slightly deviates, forming a micro-dog leg 1005 away from its straight line direction in FIG. 8.

Figure 12:
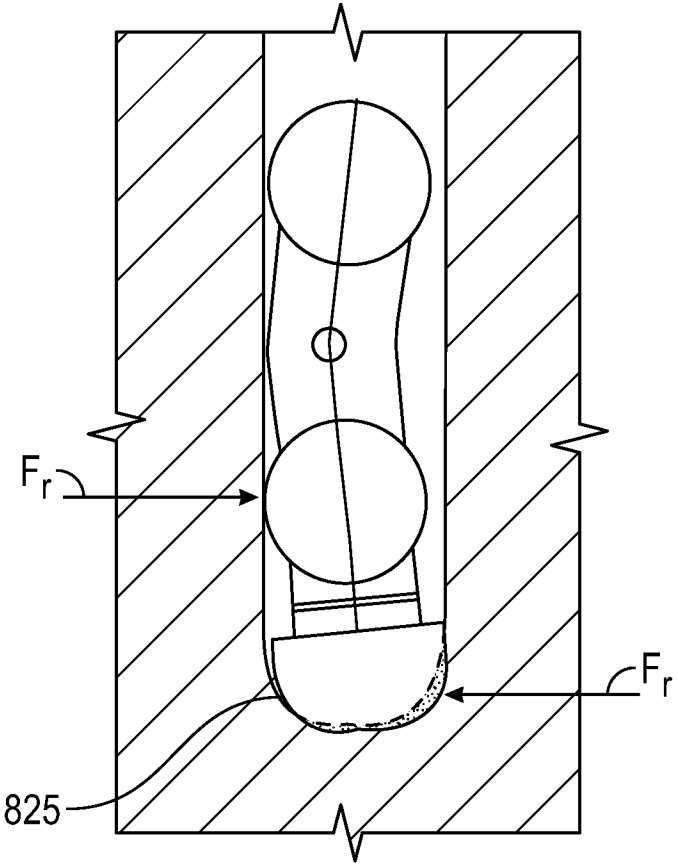
Figure 11:
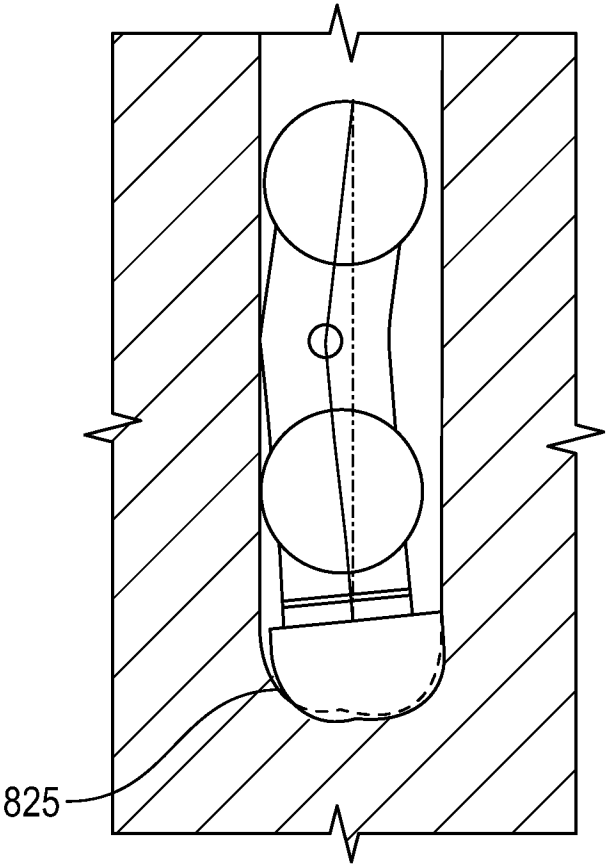

FIGS. 11 and 12 shows wellbore drilling with the SIB assembly having been rotated by 180 degrees from its direction in FIGS. 8, 9 and 10. In the configuration of FIGS. 11 and 12, a pair of reactive forces ($F_r$) are applied to the SIB assembly that straightens the bend and maintains a straight position of the SIB assembly until a time at which the toolface is stationary.

Figure 13:
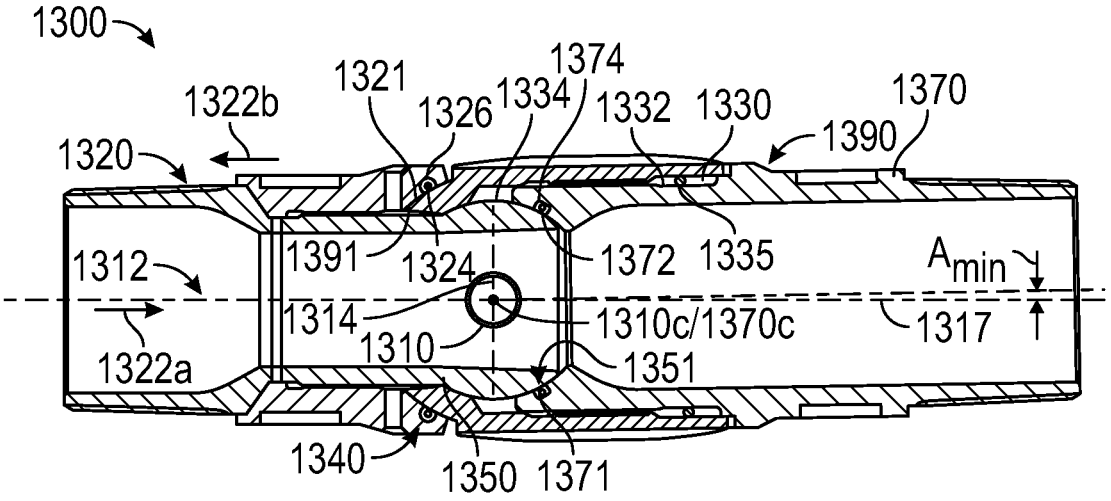
FIG. 13 shows an alternative embodiment of a deflection device that may be utilized in a drilling assembly.

FIG. 13 shows an alternative embodiment of a deflection device 1300 that may be utilized in a drilling assembly, such as drilling assembly 100 shown in FIG. 1. The deflection device 1300 incudes a pin 1310 with a pin axis 1314 perpendicular to the tool axis 1312. The pin 1310 is supported by a support member 1350. The deflection device 1300 is connected to drilling sub 1390 and includes a housing 1370. The housing 1370 includes an inner curved or spherical surface 1371 that moves over an outer mating curved or spherical surface 1351 of the support member 1350. The deflection device 1300 further includes a seal 1340 mechanism to separate or isolate a lubricating fluid (internal fluid) 1332 from the external pressure and fluids (fluid 1322*a* inside the drilling assembly and fluid 1322*b* outside the drilling assembly). In one embodiment, the deflection device 1300 includes a groove or chamber 1330 that is open to and communicates the pressure of fluid 1322*a* or 1322*b* to a lubricating fluid 1332 via a movable seal to an internal fluid chamber 1334 that is in fluid communication with the surfaces 1351 and 1371. A floating seal 1335 provides pressure compensation to the chamber 1334. A seal 1372 placed in a groove 1374 around the inner surface 1371 of the housing 1370 seals or isolates the fluid 1332 from the outside environment. Alternatively, the seal member 1372 may be placed inside a groove around the outer surface 1351 of the support member 1350. In these configurations, the center 1370*c* of the surface 1371 is the same or about the same as the center 1310*c* of the pin 1310. In the embodiment of FIG. 13, when the lower section 1390 tilts about the pin 1310, the surface 1371 along with the seal member 1372 moves over the surface 1351. If the seal 1372 is disposed inside the surface 1351, then the seal member 1372 will remain stationary along with the support member 1350.

The seal mechanism 1340 further includes a seal that isolates the lubrication fluid 1332 from the external pressure and external fluid 1322*b*. In the embodiment shown in FIG. 13, this seal includes an outer curved or circular surface 1391 associated with the lower section 1390 that moves under a fixed mating curved or circular surface 1321 of the upper section 1320, which can be the coiled tubing 102 of FIG. 1. A seal member, such as an O-ring 1324, placed in a groove 1326 around the inside of the surface 1321 seals the lubricating fluid 1332 from the outside pressure and fluid 1322*b*. When the lower section tilts about the pin 1310, the surface 1391 moves under the surface 1321, wherein the seal 1324 remains stationary. Alternatively, the seal 1324 may be placed inside the outer surface 1391 and in that case, such a seal will move along with the surface 1391.

Thus, the disclosure provides a sealed deflection device, wherein the drilling sub 1390 tilts about sealed lubricated surfaces relative to the coiled tubing 1320. In one embodiment, the drilling sub 1390 may be configured to enable the lower section 1390 to attain perfectly straight position relative to the coiled tubing 1320. In such a configuration, the tool axis 1312 and the axis 1317 of the lower section 1390 are aligned with each other. In another embodiment, the lower section 1390 may be configured to provide a permanent minimum tilt of the lower section 1390 relative to the upper section or coiled tubing 1320, such as tilt $A_{min}$ shown in FIG. 13. Such a tilt can aid the lower section 1390 to tilt from the initial position of tilt Amin to a desired tilt compared to a no initial tilt of the lower section. As an example, the minimum tilt may be 0.2 degree or greater may be sufficient for a majority of drilling operations.

Figure 14:
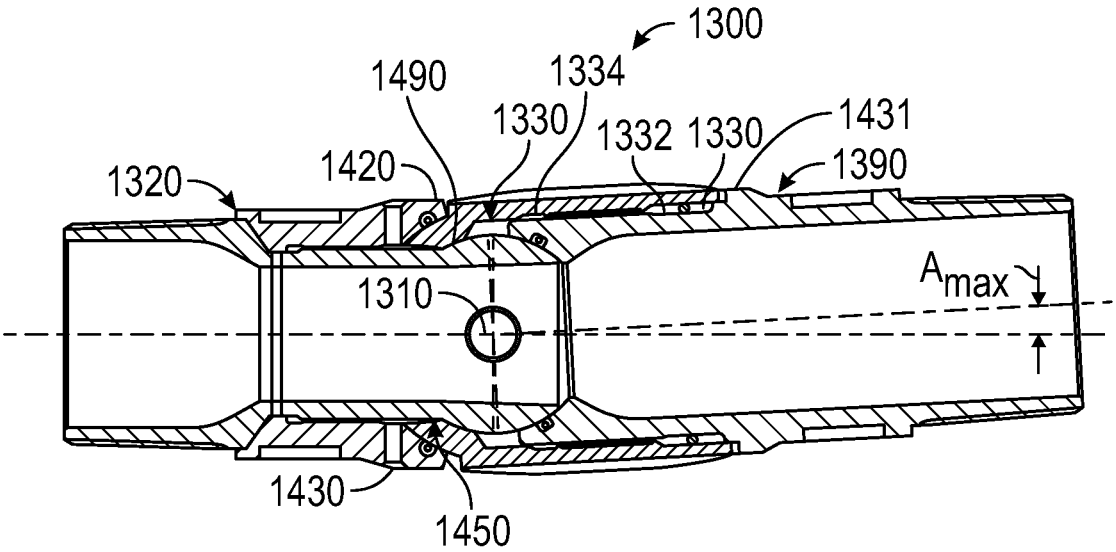
FIG. 14 shows the deflection device of FIG. 13 when the drilling sub has attained a full or maximum tilt or tilt angle with respect to the longitudinal axis of the coiled tubing.

FIG. 14 shows the deflection device 1300 of FIG. 13 when the drilling sub 1390 has attained a full or maximum tilt or tilt angle $A_{max}$ with respect to the longitudinal axis of the coiled tubing 1320. In one embodiment, when the drilling sub 1390 continues to tilt about the pin 1310, a surface 1490 of the drilling sub 1390 is stopped by a surface/shoulder 1420 of the coiled tubing 1320. A gap 1450 between the surfaces 1490 and 1420 defines the maximum tilt angle $A_{max}$. A port 1430 is provided to fill the chamber 1334 (FIG. 13) with the lubrication fluid 1332. In one embodiment a pressure communication port 1431 is provided to allow pressure communication of fluid 1322*b* outside the drilling assembly with the chamber 1330 and the pressure of the internal fluid chamber 1334 via the floating seal 1335. In FIG. 14, shoulder 1420 acts as the tilt end stop. The internal fluid chamber 1334 may also be used as a dampening device. The dampening device uses fluid present at the gap 1450 as displayed in FIG. 14 in a maximum tilt position defined by the maximum tilt angle $A_{max}$ being forced or squeezed from the gap 1450 when the tilt is reduced towards $A_{min}$. Suitable fluid passages are designed to enable and restrict flow between both sides of the gap 1450 and other areas of the fluid chamber 1334 that exchange fluid volume by movement of the deflection device. To support the dampening, suitable seals, gap dimensions or labyrinth seals may be added. The properties of the lubricating fluid 1332, such as density and viscosity for example, can be selected to adjust the dampening parameters.

Figure 15:
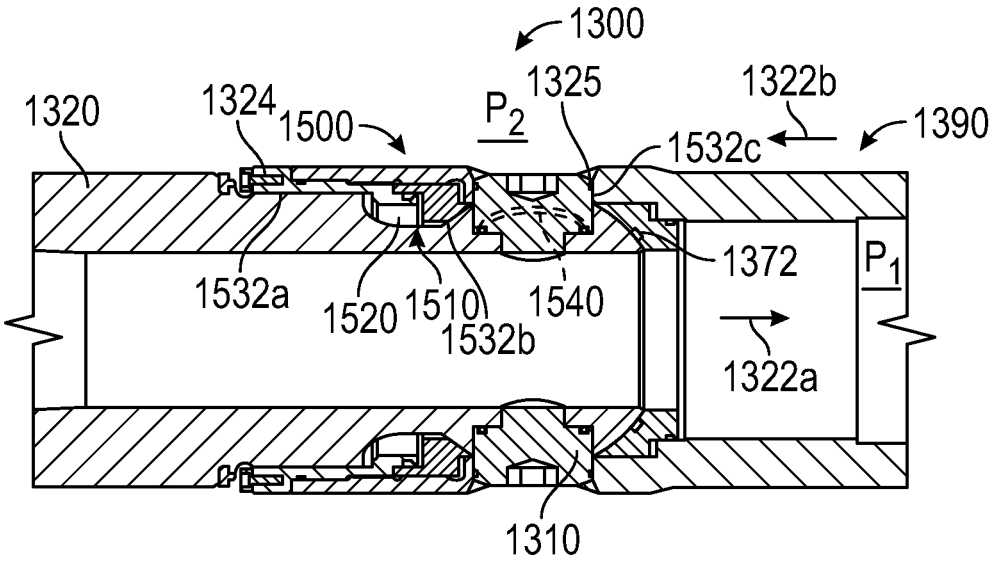
FIG. 15 is a 90 degree rotated view of the deflection device of FIG. 13 showing a sealed hydraulic section.

FIG. 15 is a 90 degree rotated view of the deflection device 1300 of FIG. 13 showing a sealed hydraulic section 1500 of the deflection device 1300. In one non-limiting embodiment, the sealed hydraulic section 1500 includes a reservoir or chamber 1510 filled with a lubricant 1520 that is in fluid communication with each of the seals in the deflection device 1300 via certain fluid flow paths. In FIG. 15, a fluid path 1532*a* provides lubricant 1520 to the outer seal 1324, fluid path 1532*b* provides lubricant 1320 to a stationary seal 1540 around the pin 1310 and a fluid flow path 1532*c* provides lubricant 1520 to the inner seal 1372. In the configuration of FIG. 15, seal 1372 isolates the lubricant from contamination from the drilling fluid 1322*a* flowing through the coiled tubing 1320 and drilling sub 1390 and from pressure P1 of the drilling fluid 1322*a* inside the coiled tubing 1320 and drilling sub 1390 that is higher than pressure P2 on the outside of the coiled tubing 1320 and drilling sub 1390 during drilling operations. Seal 1324 isolates the lubricant 1520 from contamination by the outer fluid 1322*b*. In one embodiment, seal 1324 may be a bellows seal. The flexible bellows seal may be used as a pressure compensation device (instead of using a dedicated device, such as a floating seal 1335 as described in reference to FIGS. 13 and 14) to communicate the pressure from fluid 1322*b* to the lubricant 1520. Seal 1325 isolates the lubricant 1520 from contamination by the outer fluid 1322*b* and around the pin 1310. Seal 1325 allows differential movement between the pin 1310 and the drilling sub 1390. Seal 1325 is also in fluid communication with the lubricant 1520 through fluid flow path 1532*c*. Since the pressure between fluid 1322*b* and the lubricant 1520 is equalized through seal 1324, the pin seal 1325 does not isolate two pressure levels, enabling longer service life for a dynamic seal function, such as for seal 1325.

Figure 16:
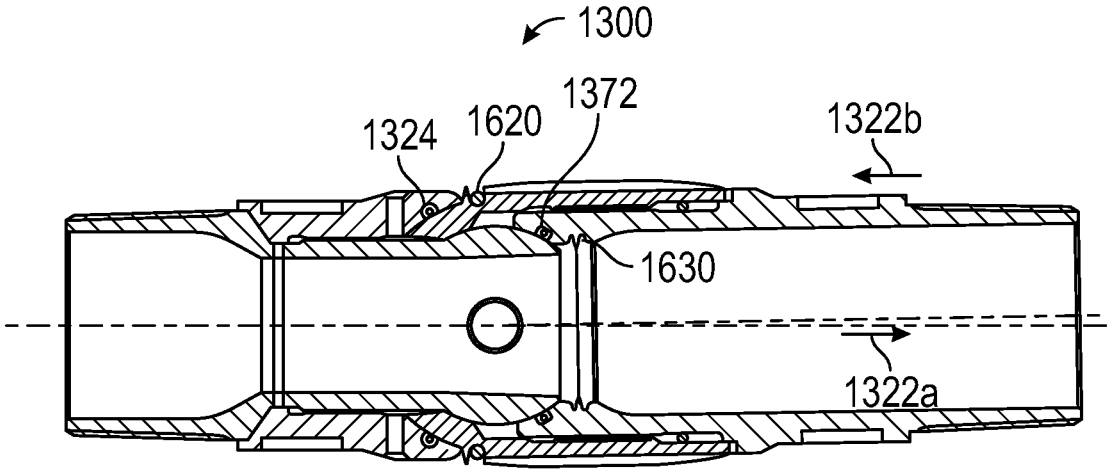
FIG. 16 shows the deflection device of FIG. 13 that may be configured to include one or more flexible seals.

FIG. 16 shows the deflection device 1300 of FIG. 13 that may be configured to include one or more flexible seals to isolate the dynamic seals 1324 and 1372 from the drilling fluid. A flexible seal is any seal that expands and contracts as the lubricant volume inside such a seal respectively increases and decreases and one that allows for the movement between parts that are desired to be sealed. Any suitable flexible may be utilized, including, but not limited to, a bellow seal, and a flexible rubber seal. In the configuration of FIG. 16, a flexible seal 1620 is provided around the dynamic seal 1324 that isolates the seal 1324 from fluid 1322*b* on the outside of the coiled tubing 1320 and drilling sub 1390. A flexible seal 1630 is provided around the dynamic seal 1372 that protects the seal 1372 from the fluid 1322*a* inside the coiled tubing 1320 and drilling sub 1390. A deflection device made according to the disclosure herein may be configured: a single seal, such as seal 1372, that isolates the fluid flowing through the drilling assembly inside and its pressure from the fluid on the outside of the drilling assembly; a second seal, such as seal 1324, that isolates the outside fluid from the inside fluid or components of the deflection device 1300; one or more flexible seals to isolate one or more other seals, such as the dynamic seals 1324 and 1372; and a lubricant reservoir, such as reservoir 1620 (FIG. 16) enclosed by at least two seals to lubricate the various seals of the deflection device 1300.

Figure 17:
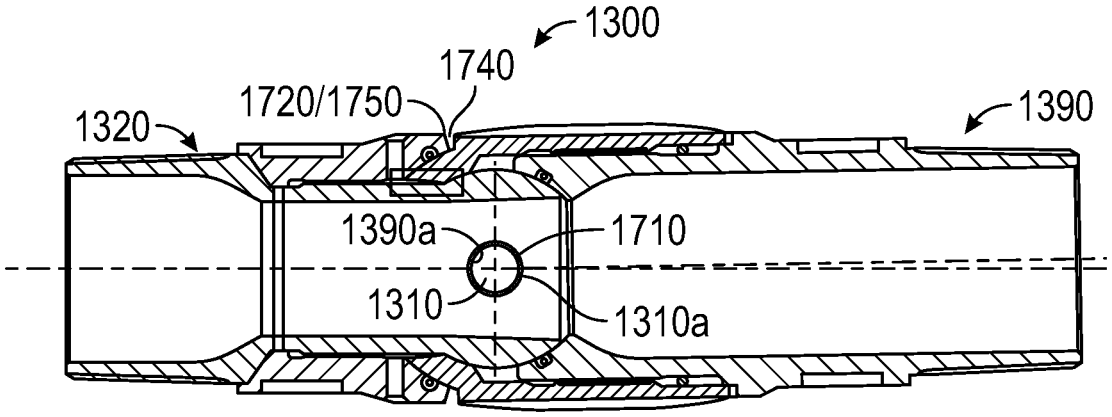
FIG. 17 shows the deflection device of FIG. 13 including a sensor that provides measurements relating to the tilt or tilt angle of the drilling sub relative to the coiled tubing.

FIG. 17 shows the deflection device 1300 of FIG. 13 that in one aspect includes a sensor 1710 that provides measurements relating to the tilt or tilt angle of the drilling sub 1390 relative to the coiled tubing 1320. In one non-limiting embodiment, sensor 1710 (also referred herein as the tilt sensor) may be placed along, about or at least partially embedded in the pin 1310. Any suitable sensor may be used as sensor 1710 to determine the tilt or tilt angle, including, but not limited to, an angular sensor, a hall-effect sensor, a magnetic sensor, and contact or tactile sensor. Such sensors may also be used to determine the rate of the tilt variation. If such a sensor includes two components that face each other or move relative to each other, then one such component may be placed on, along or embedded in an outer surface 1310*a* of the pin 1310 and the other component may be placed on, along or embedded on an inside 1390*a* of the lower section 1390 that moves or rotates about the pin 1310. In another aspect, a distance sensor 1720 may be placed, for example, in the gap 1740 that provides measurements about the distance or length of the gap 1740. The gap length measurement may be used to determine the tilt or the tilt angle or the rate of the tilt variation. Additionally, one or more sensors 1750 may be placed in the gap 1740 to provide signal relating to the presence of contact between and the amount of the force applied by the drilling sub 1390 on the coiled tubing 1320.

Figure 18:
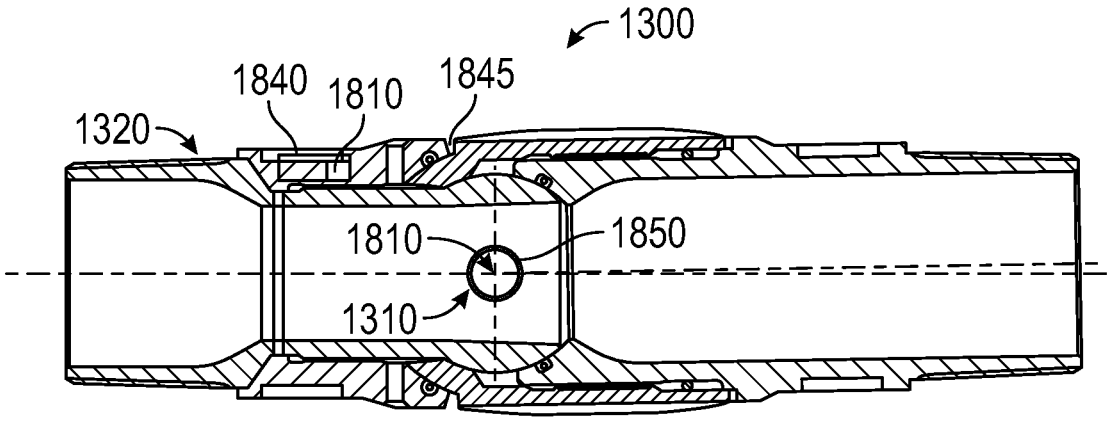
FIG. 18 shows the deflection device of FIG. 13 including sensors that provide information useful for drilling the wellbore along a desired well path.

FIG. 18 shows the deflection device 1300 of FIG. 13 that includes sensors 1810 in a section 1440 of the coiled tubing 1320 that provide information about the drilling assembly parameters and the wellbore parameters that are useful for drilling the wellbore along a desired well path, sometimes referred to in the art as "geosteering". Some such sensors may include sensors that provide measurements relating to parameters such as tool face, inclination (gravity), and direction (magnetic). Accelerometers, magnetometers, and gyroscopes may be utilized for such parameters. In addition, a vibration sensor may be located at location 1840. In one non-limiting embodiment, section 1840 may be in the coiled tubing 1320 proximate to the end stop 1845. Sensors 1810, however, may be located at any other suitable location in the drilling assembly above or below the deflection device 1300 or in the drill bit. In addition, sensors 1850 may be placed in the pin 1310 for providing information about certain physical conditions of the deflection device 1300, including, but not limited to, torque, bending and weight. Such sensors may be placed in and/or around the pin 1310 as relevant forces relating to such parameters are transferred through the pin 1310.

Set forth below are some embodiments of the foregoing disclosure:

Embodiment 1. A method of drilling a wellbore. The method includes disposing a tubing in the wellbore, the tubing including an orientation device coupled to the tubing and a drilling sub connected to the orientation device and rotatable by the orientation device. The drilling sub includes a drive configured to rotate a drill bit at an end of the drilling sub, a housing having a first section and a second section, and a pivot member coupled to the first section and second section of the housing. A tilt is produced between the second section and the first section of the housing about the pivot member by maintaining the orientation device rotationally stationary to allow drilling of a curved section of the wellbore via rotation of the drive. The orientation device is rotated to reduce the tilt between the first section and the second section, thereby allowing drilling of a straighter section of the wellbore.

Embodiment 2. The method of any prior embodiment, wherein the orientation device includes a stator section affixable to the tubing and a rotor section rotatable with respect to the stator section, the drilling sub being coupled to the rotor section.

Embodiment 3. The method of any prior embodiment, further comprising rotating the orientation device to rotate the rotor section in one of a clockwise direction and a counter-clockwise direction.

Embodiment 4. The method of any prior embodiment, further comprising inverting a toolface direction of the housing via the orientation device to reduce a tortuosity of the wellbore.

Embodiment 5. The method of any prior embodiment, further comprising initiating the tilt when an axial load is applied on the drilling assembly.

Embodiment 6. The method of any prior embodiment, further comprising initiating the tilt via a force application device.

Embodiment 7. The method of any prior embodiment, wherein the force application device is selected from a group consisting of: (i) a spring that applies a force on the second section; and (ii) a hydraulic device that applies a force on the second section in response to a pressure differential.

Embodiment 8. A drilling system including a tubing, an orientation device affixed to the tubing, a drilling sub having a housing having a first section and a second section, wherein the first section is coupled to a movable element of the orientation device, a shaft disposed in the housing, the shaft coupled to the drive and to the drill bit, and a pivot member coupled to the first section and second section of the housing, wherein the second section of the housing tilts relative to the first section of the housing about the pivot member when the orientation device is rotationally stationary to allow drilling of a curved section of the wellbore, and wherein rotation of the housing via the orientation device reduces the tilt between the first section and the second section to allow for drilling of a straighter section of the wellbore.

Embodiment 9. The system of any prior embodiment, wherein the orientation device includes a stator section affixed to the tubing and a rotor section rotatable with respect to the stator section, the drilling sub being coupled to the rotor section.

Embodiment 10. The system of any prior embodiment, wherein the orientation device is rotatable the rotor section in at least one of: a clockwise direction and a counter-clockwise direction.

Embodiment 11. The system of any prior embodiment, wherein the orientation device is configured to invert a toolface direction of the housing to reduce a tortuosity of the wellbore.

Embodiment 12. The system of any prior embodiment, wherein the pivot member is selected from a group consisting of: (i) a pin; and (ii) a ball joint.

Embodiment 13. The system of any prior embodiment, wherein the housing is further configured to initiate the tilt when an axial load is applied on the drilling assembly.

Embodiment 14. The system of any prior embodiment, further comprising a force application device that exerts a force on the housing to initiate the tilt.

Embodiment 15. The system of any prior embodiment, wherein the force application device is selected from a group consisting of: (i) a spring that applies a force on the second section; and (ii) a hydraulic device that applies a force on the second section in response to a pressure differential.

Embodiment 16. The system of any prior embodiment, further comprising a tilt sensor that provides measurements relating to the tilt between the tubing and the drilling sub.

Embodiment 17. The system of any prior embodiment, further comprising a directional sensor that provides measurements relating to a direction of the drilling sub.

Embodiment 18. The system of any prior embodiment, further comprising a force sensor that provides measurements relating to force applied by the drilling sub on the tubing.

Embodiment 19. The system of any prior embodiment, further comprising at least one seal that seals at least a portion of a surface of the pivot member.

Embodiment 20. The system of any prior embodiment, further comprising a dampening device configured to dampen variation of the tilt.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of drilling a wellbore, comprising:

disposing a drilling assembly in the wellbore, the drilling assembly including:

a tubing;

an orientation device disposed within the tubing;

a housing having a first section and a second section, wherein the first section is coupled to the orientation device and rotatable with respect to the tubing by the orientation device:

a drive disposed in the housing, the drive configured to rotate a drill bit at an end of the second section; and a pivot member that couples the first section to the second section;

providing a first signal from a surface location to the orientation device;

drilling, in response to the first signal, a curved section of the wellbore by maintaining the housing rotationally stationary to produce a tilt angle between the second section and the first section about the pivot member;

providing a second signal from a surface location to the orientation device; and drilling, in response to the second signal, a straighter section of the wellbore by rotating the housing via the orientation device to reduce the tilt angle between the first section and the second section.

2. The method of claim 1, wherein the orientation device includes a stator section affixed to the tubing and a rotor section rotatable with respect to the stator section, the first section of the housing being coupled to the rotor section.

3. The method of claim 2, wherein rotating the orientation device further comprises rotating the rotor section in one of a clockwise direction and a counter-clockwise direction.

4. The method of claim 1, further comprising inverting a toolface direction of the housing via the orientation device to reduce a tortuosity of the wellbore.

5. The method of claim 1, further comprising initiating the tilt angle when an axial load is applied on the drilling assembly.

6. The method of claim 1, further comprising initiating the tilt angle via a force application device.

7. The method of claim 6, wherein the force application device is selected from a group consisting of: (i) a spring that applies a force on the second section; and (ii) a hydraulic device that applies a force on the second section in response to a pressure differential.

8. A drilling system, comprising:

a tubing;

an orientation device disposed within the tubing;

a housing having a first section and a second section, wherein the first section is coupled to the orientation device and is rotatable with respect to the tubing via the orientation device;

a drive disposed in the housing, the drive configured to rotate a drill bit at an end of the second section;

a shaft disposed in the housing, the shaft coupling the drive to the drill bit; and a pivot member that couples the first section to the second section, wherein a first signal provided to the orientation device from a surface location causes the orientation device to maintain the housing rotationally stationary while drilling to produce a tilt angle between the second section and the first section about the pivot member that causes drilling of a curved section of the wellbore, and wherein a second signal provided to the orientation device from the surface location causes the orientation device to rotate the housing to reduce the tilt angle between the first section and the second section.

9. The drilling system of claim 8, wherein the orientation device includes a stator section affixed to the tubing and a rotor section rotatable with respect to the stator section, the first section of the housing being coupled to the rotor section.

10. The drilling system of claim 9, wherein the orientation device is rotatable with respect to the rotor section in at least one of: a clockwise direction and a counter-clockwise direction.

11. The drilling system of claim 8, wherein the orientation device is configured to invert a toolface direction of the housing to reduce a tortuosity of the wellbore.

12. The drilling system of claim 8, wherein the pivot member is selected from a group consisting of: (i) a pin; and (ii) a ball joint.

13. The drilling system of claim 8, wherein the housing is further configured to initiate the tilt angle when an axial load is applied on the housing.

14. The drilling system of claim 8 further comprising a force application device that exerts a force on the housing to initiate the tilt angle.

15. The drilling system of claim 14, wherein the force application device is selected from a group consisting of: (i) a spring that applies a force on the second section; and (ii) a hydraulic device that applies a force on the second section in response to a pressure differential.

16. The drilling system of claim 8, further comprising a tilt sensor that provides measurements relating to the tilt angle between the first section and the second section.

17. The drilling system of claim 8, further comprising a directional sensor that provides measurements relating to a direction of the tubing.

18. The drilling system of claim 8 further comprising a force sensor that provides measurements relating to a force applied by the housing on the tubing.

19. The drilling system of claim 8, further comprising at least one seal that seals at least a portion of a surface of the pivot member.

20. The drilling system of claim 8, further comprising a dampening device configured to dampen a variation of the tilt angle.

21. The method of claim 1, wherein at least one of the first signal and the second signal is an electrical signal.

22. The drilling system of claim 8, wherein at least one of the first signal and the second signal is an electrical signal.

* * * * *